US006742306B2

(12) United States Patent
Petschke et al.

(10) Patent No.: US 6,742,306 B2
(45) Date of Patent: Jun. 1, 2004

(54) METHOD FOR CARRYING OUT WORK ON AN OBJECT RELATED TO SHIPBUILDING OR BUILDING CONSTRUCTION OR INDUSTRIAL INSTALLATIONS

(75) Inventors: Christian Petschke, Börnsen (DE); Wulf-Dieter Greverath, Hamburg (DE); Gerd Herrmann, Seevetal (DE)

(73) Assignee: Muhlhan Surface Protection International GmbH, Hamburg (DE)

( * ) Notice: Subject to any disclaimer, the term of this patent is extended or adjusted under 35 U.S.C. 154(b) by 187 days.

(21) Appl. No.: 09/991,483

(22) Filed: Nov. 16, 2001

(65) Prior Publication Data

US 2002/0066398 A1 Jun. 6, 2002

(51) Int. Cl.[7] ..... E04F 19/00
(52) U.S. Cl. ..... 52/27; 52/698
(58) Field of Search ..... 52/27, 698

(56) References Cited

U.S. PATENT DOCUMENTS

| | | | | |
|---|---|---|---|---|
| 1,360,002 A | | 4/1920 | Bonard | |
| 1,976,595 A | * | 10/1934 | Asleson et al. | 248/228.1 |
| 5,355,818 A | | 10/1994 | Strait et al. | |
| D419,699 S | * | 1/2000 | Stodola | D25/199 |

FOREIGN PATENT DOCUMENTS

| | | |
|---|---|---|
| DE | 1 534 973 | 9/1969 |
| DE | 7415869 | 12/1974 |
| DE | 3840761 A1 | 6/1990 |
| DE | 295 00 048.1 | 5/1995 |
| JP | 5-214808 | 8/1993 |
| JP | 10-292621 | 11/1998 |

OTHER PUBLICATIONS

Hawley's Condensed Chemical Dictionary, 1997, John Wiley & Sons, Inc. 13, 619, 620, 1047, 1048.*

* cited by examiner

*Primary Examiner*—Carl D. Friedman
*Assistant Examiner*—Steve Varner
(74) *Attorney, Agent, or Firm*—Roberts & Roberts, LLP

(57) ABSTRACT

The invention relates to a method for carrying out work on an object of shipbuilding or building construction or industrial installations by means of hanging stages or cradles, which are connected to the object by means of a plurality of U-shaped fixtures. For a long time this method has suffered from the disadvantage that subsequent welding, flexing, breaking away and similar work led to damage to adjacent surfaces. It was also necessary to dispose of the separated U-fixtures or irons. This problem is obviated by the invention in that waterproof, stainless base plates (10) are fixed in spaced manner to the object so as to remain permanently thereon and the fixtures (16) are fixed to the base plate (10) by means of a redetachable screw or plug-in connection (14) and following the detachment and removal of the reusable fixtures (16) from the base plate (10), the screw or plug-in connection (14) is closed.

14 Claims, 1 Drawing Sheet

METHOD FOR CARRYING OUT WORK ON AN OBJECT RELATED TO SHIPBUILDING OR BUILDING CONSTRUCTION OR INDUSTRIAL INSTALLATIONS

BACKGROUND OF THE INVENTION

The present invention relates to a method for carrying out work on an object relating to shipbuilding or building construction or industrial installations by means of hanging stages, which are connected to said object by means of a plurality of U-shaped fixtures. Such a method has been used for decades in the prior art.

If in shipbuilding, industrial installations or building construction in general stages or cradles are required, they are generally raised up to the object from the ground, i.e. standing on a firm substrate. Following the construction said stages are anchored to the object so that they are stable, particularly in gales. The number of anchor ties on the object is a function of statics and object geometry. These anchor ties must be removed again when the stage is dismantled.

Hanging stages are used if the cradle cannot be built up from the ground as a result of local or other conditions. These constitute demanding stage structures, which can only be erected by specialists and requiring special statics for each object. It is vital with such hanging stages that the object part carrying said stage is completed to such an extent that statically it permits the attachment of a hanging stage.

"For fixing the hanging stages to the object it is necessary to fit attachments, so-called stage anchor ties and this takes place through the fitting of U-irons, in which the hanging stages are inserted or otherwise secured. In shipbuilding or industrial construction fitting takes place by welding the U-irons to the object. On dismantling the stage said attachments must be cut off with a separating disk, separated with a welding torch. Naturally such work leads to significant damage to the surface, together with windows and other means in the vicinity thereof."

From such hanging stages are carried out not only building work, but also surface coating, together with the final painting of the objects, which takes place around and beneath the U-irons to which the hanging stage is fitted. Surface treatment below the U-irons can only be performed after they have been removed.

"The removal of the U-irons by cutting off wheels as well as welding torches or breaking away the wall generally leads to the separation not only of the U-irons, but also the surrounding outer surface is again damaged by the spurting out, hot steel cuttings, flying sparks, dust, wall fragments, whilst the inner surfaces are damaged by the resulting heat and must then be repaired or completely recoated. In addition, the surface beneath the U-irons can only be coated following separation. As a result it is not possible to obtain an optically satisfactory coating, particularly a final paint coating, which is desired when high demands are made concerning the appearance such as in cruise ships, specific industrial and steel structures, as well as in high buildings."

Therefore the problem of the present invention is to install a hanging stage without the aforementioned disadvantages, i.e. without subsequent welding, flexing, breaking away or similar work, which can damage adjacent surfaces and the like and correspondingly improve the aforementioned method.

BRIEF SUMMARY OF THE INVENTION

According to the invention this problem is surprisingly solved in that watertight, stainless base plates, which are spaced from one another, are fixed to the object so as to permanently remain thereon and the fixtures (16) are in each case fixed by a redetachable screw or plug-in connection (14) to the base plate (10) and after detaching and removing the reusable fixtures (16) from the base plate (10) the screw or plug-in connection (14) is closed.

According to the method of the invention the hanging stage or cradle is fixed as in known methods to U-shaped fixtures, but with the difference that said fixtures are not permanently secured, but instead detachably secured to the object and on the side facing the object the U-fixtures can be provided with a protective coating to prevent scratching. The U-fixtures are secured in the manner described hereinafter.

To the object base plates having an opening are fixed in a permanent manner and to the same can be secured the U-fixtures by means of screw, plug-in or some other connection. Following the dismantling of the U-fixtures the openings are closed by blind screws, plugs, etc.

The base plate is made from steel alloys which are not attacked by the given use or by an iron plate coated with the coating system used on the object. During or before the erection of the hanging stage, the base plate is inserted in or placed on the object. However, through a prior coating of the given object surface, the base plate can be replaced by the actual surface in which, assuming that this is permitted by the statics of the objects, the necessary screw, plug-in or other connections can be formed, which are closed again after removing the U-fixtures.

In all cases on dismantling the stage there is no damage to the surface and the formation of a uniform surface coating is ensured.

The base plates can always be reused as a basis for the fixture of future hanging stages.

BRIEF DESCRIPTION OF THE DRAWINGS

A preferred embodiment of the invention is described hereinafter in non-limitative manner and with reference to the attached drawings, wherein show.

DETAILED DESCRIPTION OF THE EMBODIMENT

Figure 1:
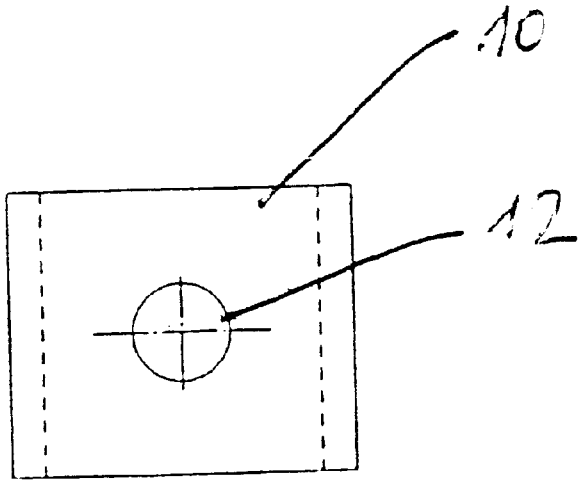
FIG. 1 A diagrammatic plan view of a base plate inserted in accordance with the method of the invention.

In FIG. 1 the base plate according to the invention 10 is welded to a ship's plating (not shown). It has a rectangular shape and a centrally located circular threaded opening 12. This base plate is made from sea water-resistant, stainless chrome nickel steel. The shape and size of the base plate inserted according to the invention are not critical, but can be selected within a random range in accordance with the static requirements, i.e. can also be circular. The situation is the same regarding the material, other materials being conceivable for the expert. However, it should be clear that the base plate 10 must be able to withstand for years the atmospheric influences with or without a coating, because it is permanently fixed to the not shown object. The number of base plates 10 used in the method of the invention is not critical and is instead decided by the expert on the basis of the dimensions of the object and the not shown hanging stages used.

Figure 2:
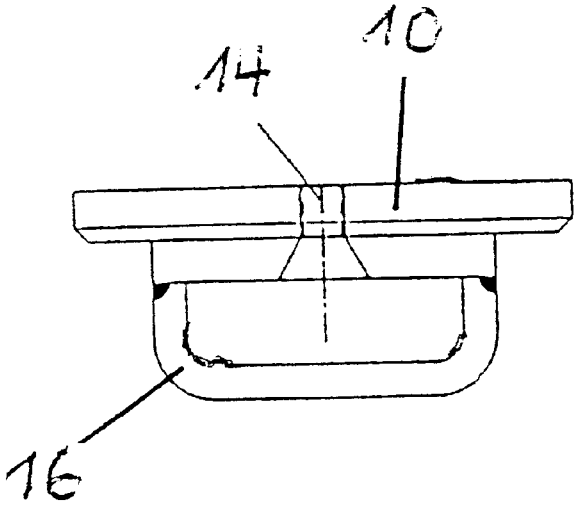
FIG. 2 A diagrammatic view from above of a base plate with a U-shaped fixture inserted in accordance with the method of the invention.

In FIG. 2 the base plate 10 is viewed differently, namely with the U-shaped fixture 16, which is secured by means of a screw 14 to the base plate 10, said screw being screwed into the opening 12. It should be clear to the expert that now the not shown hanging stages can be nested or otherwise fastened using corresponding hooks/anchor ties in the free space 18. After carrying out the necessary work on the hull, the fixture 16 is removed from the base plate by loosening the screw 14. The fixture 16 can be reused subsequently on another object, whereas the base plate 10 remains on the object in question in such a way that following the loosening of the screw 14 this or a further screw is screwed into the opening 10 in order to produce a continuous surface.

What is claimed is:

1. A method for carrying out work on an object of shipbuilding or building construction or industrial installations which comprises connecting a plurality of hanging stages onto an object of shipbuilding or building construction or an industrial installation, which hanging stages comprise a stainless base plate and a U-shaped fixture removably attached to the base plate, wherein the stainless base plates are connected to the object and spaced from one another so as to permanently remain connected to the object, and attaching the fixtures by a detachable screw or plug-in connection to the base plate and closing the screw or plug-in connection after detaching and removing the fixtures from the base plate.

2. The method according to claim 1, wherein the base plates comprise chrome nickel steel or an iron plate coated with a protective coating.

3. The method according to claim 1, wherein the base plate is inserted in or placed on the object.

4. The method according to claim 1, wherein the base plates are fixed, to the outer wall of a ship.

5. The method according to claim 2, wherein the base plate is inserted in or placed on the object.

6. The method according to claim 2, wherein the base plates are fixed to the outer wall of a ship.

7. The method according to claim 3, wherein the base plates are fixed to the outer wall of a ship.

8. The method according to claim 7, wherein the base plates are welded to the outer wall of a ship.

9. A method for carrying out work on a wall of a building or ship, comprising the steps of:

a) permanently attaching a plurality of base plates to a wall of a building or ship;

b) detachably securing at least one U-shaped fixture to each base plate via a detachable screw or plug-in connection;

c) performing a work operation on the wall;

d) removing the U-shaped fixtures from the base plates; and e) closing any openings which remain in the base plates.

10. The method according to claim 9 wherein the base plates comprise a steel alloy.

11. The method according to claim 9 wherein the base plates comprise chrome nickel steel.

12. The method according to claim 9 wherein the base plates comprise an iron plate.

13. The method according to claim 9 wherein the fixture comprises a protective coating.

14. The method according to claim 9 wherein the base plates are welded to the outer wall of a ship.

* * * * *